US008578907B2

(12) United States Patent
Kawamata et al.

(10) Patent No.: US 8,578,907 B2
(45) Date of Patent: Nov. 12, 2013

(54) INTERNAL COMBUSTION ENGINE WITH VARIABLE FLOW RATE OIL PUMP APPARATUS, AND MOTORCYCLE INCORPORATING SAME

(75) Inventors: Noriyuki Kawamata, Saitama (JP); Toshimasa Mitsubori, Saitama (JP); Satoshi Ino, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 256 days.

(21) Appl. No.: 13/227,918

(22) Filed: Sep. 8, 2011

(65) Prior Publication Data

US 2012/0067320 A1 Mar. 22, 2012

(30) Foreign Application Priority Data

Sep. 16, 2010 (JP) ..... 2010-208449

(51) Int. Cl.
*F01M 1/02* (2006.01)

(52) U.S. Cl.
USPC ..... 123/196 R; 184/6.5

(58) Field of Classification Search
USPC ..... 123/196 R; 184/6.5
See application file for complete search history.

(56) References Cited

U.S. PATENT DOCUMENTS 4,058,981 A * 11/1977 Henson ..... 184/6.3
5,918,573 A * 7/1999 Killion ..... 123/196 R
6,589,025 B2 7/2003 Hojyo et al.
7,261,079 B2 8/2007 Gunji et al.
2005/0098385 A1 5/2005 Ono et al.
2006/0112907 A1 6/2006 Nakatsuka et al.

FOREIGN PATENT DOCUMENTS

DE 101 40 876 A1 5/2002
DE 10 2005 061953 A1 7/2006
JP 09-088538 A 3/1997
JP 2005-140022 A 6/2005

OTHER PUBLICATIONS

Voigt, D., "Kraftstoffverbrauchsvorteile durch Regelolpumpen", MTZ-Motortechnische Zeitschrift, Jahrgang 64, Dec. 2003, pp. 1050-1057, ISSN 0024-8525.

* cited by examiner

*Primary Examiner* — Noah Kamen
(74) *Attorney, Agent, or Firm* — Carrier Blackman & Associates, P.C.; Joseph P. Carrier; William D. Blackman

(57) ABSTRACT

An internal combustion engine includes a crankshaft, a variable flow rate oil pump apparatus including oil pumps having a drive shaft thereof operatively connected with the crankshaft, and a rod-shaped oil passage switching valve operatively connected with the oil pumps. The oil passage switching valve and the drive shaft of the oil pumps are arranged such that axial directions thereof are parallel to an axial direction of the crankshaft. Also, the oil pumps and the oil passage switching valve are disposed so as to overlap each other in the axial direction of the crankshaft. With such configuration of the engine, the effect on various components around the pump can be reduced, while downsizing the oil pump and the engine.

20 Claims, 8 Drawing Sheets

INTERNAL COMBUSTION ENGINE WITH VARIABLE FLOW RATE OIL PUMP APPARATUS, AND MOTORCYCLE INCORPORATING SAME

CROSS-REFERENCE TO RELATED APPLICATIONS

The present invention claims priority under 35 USC 119 based on Japanese patent application No. 2010-208449, filed on Sep. 16, 2010. The entire subject matter of this priority document, including specification claims and drawings thereof, is incorporated by reference herein.

BACKGROUND OF THE INVENTION

1. Field of the Invention

The present invention relates to an internal combustion engine having a variable flow rate oil pump apparatus, and to a motorcycle including the same. More particularly, the present invention relates to an internal combustion engine having a variable flow rate oil pump apparatus in which an oil passage switching valve arranged in discharge ports of the oil pump apparatus, and a drive shaft of the oil pump apparatus are arranged parallel to a crankshaft of the engine, and to a motorcycle incorporating the same.

2. Description of the Background Art

There is a known variable flow rate oil pump apparatus which has a pump rotor operatively interlocking with a crankshaft of an engine for concurrent rotation therewith, and the known apparatus has a rod-shaped oil passage switching valve arranged in a discharge port of the pump. In the known variable flow rate oil pump apparatus, a hydraulic pressure return opening that faces the discharge port is effectively opened and closed by the operation of the oil passage switching valve, and accordingly, the discharge amount of the entire pump unit can be controlled.

An example of such engine with variable flow rate oil pump apparatus is disclosed in Japanese Unexamined Patent Publication No. 2005-140022.

In the conventional configuration, such as discussed in Japanese Unexamined Patent Publication No. 2005-140022, an axial direction of the oil passage switching valve is arranged so as to be perpendicular to an axial direction of the rotor drive shaft, and thus, also perpendicular to the axial direction of the crankshaft of the engine.

However, when this configuration is applied to an engine for a small vehicle, such as a motorcycle, there is a problem that parts around the pump are likely to be restricted, due to the fact that the space is needed for disposing the oil passage switching valve in the direction which is perpendicular to the axial direction of a rotor drive shaft. With such known configuration, the oil pump, and the engine which contains the oil pump, are likely to become larger.

The present invention has been made to overcome the drawbacks of the known configuration of an engine with a variable flow rate oil pump apparatus. Accordingly, it is one of the objects of the present invention is to reduce the effect on parts around the pump, and simultaneously, to downsize the oil pump, and also to minimize size of the engine having a variable flow rate oil pump apparatus with a rod-shaped oil passage switching valve.

SUMMARY OF THE INVENTION

In the following description, reference numbers are given which refer to components shown in the attached drawings.

Such referenced components, as shown in the drawings, are intended to illustrate rather than to limit the present invention.

In order to achieve the above objects, the present invention according to a first aspect thereof is characterized in that an internal combustion engine is provided with a variable flow rate oil pump apparatus (31) including a plurality of oil pumps (36, 37) arranged inside a pump body (38), and these oil pumps include respective pump rotors (36*d*, 37*d*) which are interlockingly driven with a crankshaft (21) for concurrent rotation thereof. The variable flow rate oil pump apparatus (31) also includes a rod-shaped oil passage switching valve (51) arranged in discharge ports (36*c*, 37*c*) of the oil pumps (36, 37) in the pump body (38).

The variable flow rate oil pump apparatus (31) including the oil pumps (36, 37) according to the first aspect hereof, is operable to control the discharge amount of (the entire) pump apparatus due to the fact that oil return openings (63, 66) facing to the discharge ports (36*c*, 37*c*) of the oil pumps 36, 37 are opened and closed by the operation of the oil passage switching valve (51).

In the engine according to the first aspect, an axial direction of the oil passage switching valve (51) and an axial direction of a drive shaft (32) of the oil pumps (36, 37) are disposed so as to be parallel to the axial direction of the crankshaft (21).

The present invention according to a second aspect thereof is characterized in that the oil pumps (36, 37) and the oil passage switching valve (51) are disposed so as to overlap each other in the axial direction of the crankshaft (21).

The present invention according to a third aspect thereof is characterized in that an oil pan (29) is arranged under a crankcase (22) having the crankshaft (21) arranged therein, a strainer (43) extending in the vertical direction is provided inside the oil pan (29), the strainer (43) and at least one of the oil pumps (36, 37) and the oil passage switching valve (51) are disposed so as to overlap each other in the axial direction of the crankshaft (21).

The present invention according to a fourth aspect thereof is characterized in that the oil pumps (36, 37) are coaxially positioned.

The present invention according to a fifth aspect thereof is characterized in that each oil pump (36, 37) shares the strainer (43).

The present invention according to a sixth aspect thereof is characterized in that a scavenging pump (33) is coaxially arranged with each oil pump (36, 37), an opening (22*c*) connecting an inlet (33*e*) of the scavenging pump (33) is formed on the bottom wall (22*b*) of the crank chamber (22*a*) of the crankcase (22).

The present invention according to a seventh aspect thereof is characterized in that a transmission unit (27) which shifts rotary power of the crankshaft (21) has an input shaft (27*a*) which is parallel to the axial direction of the crankshaft (21), when viewed from the axis direction of the crankshaft (21) and the input shaft (27*a*), and the oil pumps (36, 37) are disposed between a vertical line (B0) passing through a shaft center (C0) of the crankshaft (21) and a vertical line (B3) passing through a shaft center (C3) of the input shaft (27*a*).

The present invention according to an eighth aspect thereof is characterized in that the oil passage switching valve (51) is disposed in the obliquely lower part of the oil pumps (36, 37).

The present invention according to a ninth aspect thereof is characterized in that an oil filter (44) is disposed in the obliquely upper part of the oil passage switching valve (51) when viewed from the axis direction of the crankshaft (21).

The present invention according to a tenth aspect thereof is characterized in that one side in the longitudinal direction of the oil passage switching valve (51) is formed as an oil passage forming portion (52*a*), another side thereof is formed as a drive portion (52*b*), and the oil passage forming portion (52*a*) is installed in the oil pumps (36, 37).

EFFECTS OF THE INVENTION

According to the first and second aspects of the present invention, the layout space of the oil pump including the oil passage switching valve can be reduced, the effect on parts around the pump is restricted, and simultaneously, the oil pump and thus the engine can be downsized.

According to the third aspect of the present invention, due to the fact that the strainer, the oil pump, and the oil passage switching valve are adjacently disposed in the axial direction of the crankshaft, the oil pump can be downsized furthermore.

According to the fourth aspect of the present invention, a plurality of oil pumps can be arranged at a predetermined position without increasing the pump drive shaft.

According to the fifth aspect of the present invention, the structure around the oil pump can be simplified without providing the strainer and the inlet on each oil pump.

According to the sixth aspect of the present invention, the scavenging pump can be compactified by integrally provided with each oil pump, and simultaneously, the oil inside of the crank chamber can be efficiently discharged into the oil pan.

According to the seventh aspect of the present invention, the oil pump can be efficiently disposed in the downward space between the crankshaft and the input shaft.

According to the eighth of the present invention, the oil pump can be downsized by reducing the width in the front and rear direction and the width in the upper and lower direction.

According to the ninth aspect of the present invention, the space formed by obliquely and downwardly offsetting the oil passage switching valve can be effectively use as a layout space for an oil passage switching valve of the oil filter.

According to the tenth aspect of the present invention, the valve installing structure can be simplified by installing only the oil passage forming portion of the oil passage switching valve in the oil pump.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF ILLUSTRATIVE EMBODIMENTS

Figure 1:
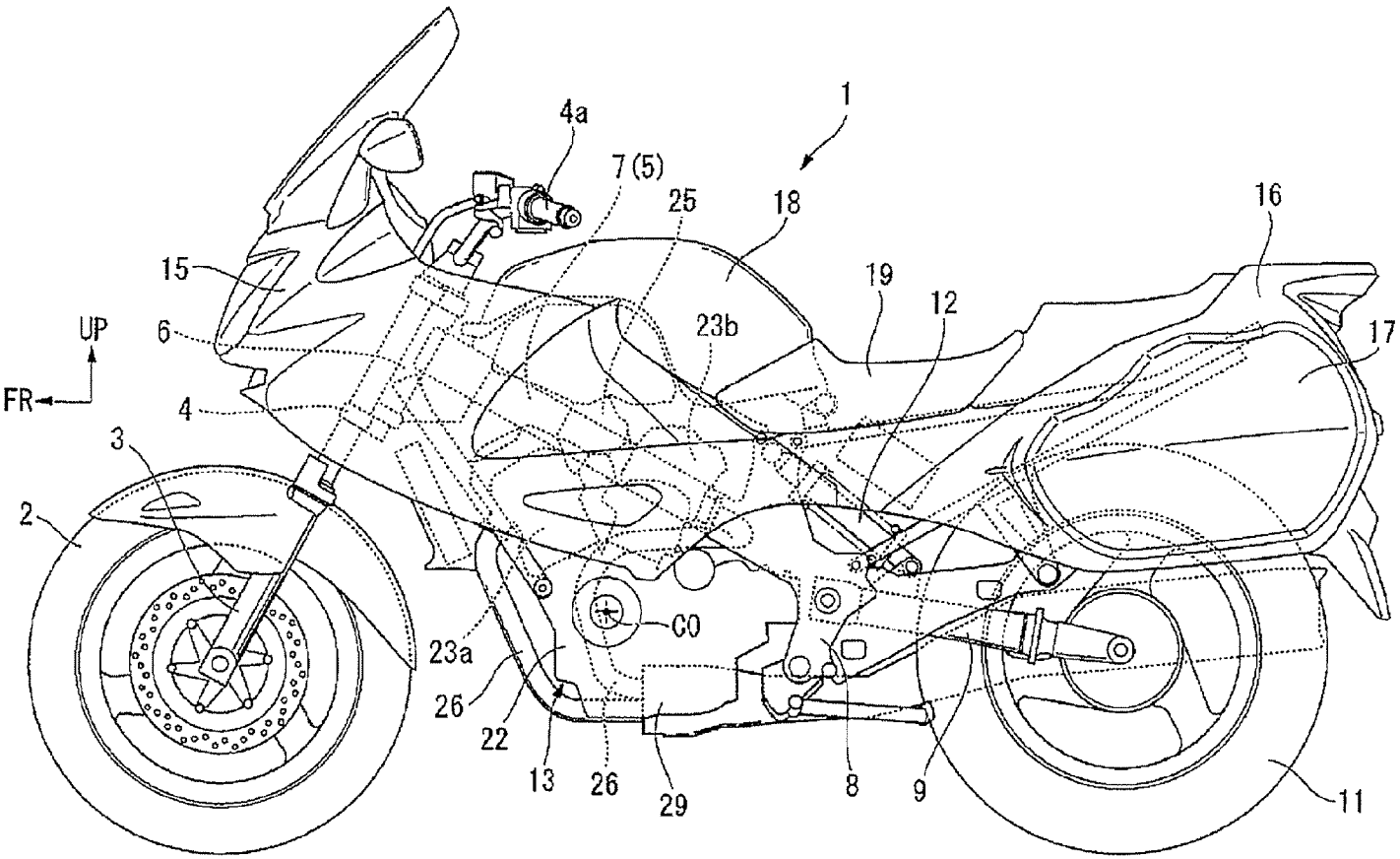
FIG. 1 is a left side view of a motorcycle equipped with a variable flow rate oil pump apparatus according to an illustrative embodiment of the present invention.

An embodiment of the present invention will now be described, with reference to the drawings. Throughout this description, relative terms like "upper", "lower", "above", "below", "front", "back", and the like are used in reference to a vantage point of an operator of the vehicle, seated on the driver's seat and facing forward. It should be understood that these terms are used for purposes of illustration, and are not intended to limit the invention.

That is, the illustrative embodiment of the present invention will be explained with reference to the drawings. In addition, without specific description, the directions such as "front" and "rear", "right" and "left" will be explained as same as the directions of the vehicle, as explained herein. At appropriate positions in the drawings which are used for the explanation hereinafter, an arrow FR shows the forward direction of the vehicle, an arrow LH shows the left side of the vehicle, an arrow UP shows an upward direction of the vehicle.

A motorcycle (straddle-type vehicle) 1, equipped with a variable flow rate oil pump apparatus according to the present invention, is shown in FIG. 1. The motorcycle 1 includes a front wheel 2 supported on a lower end portion of a front fork 3. An upper part of the front fork 3 is pivotally and steerably supported on a head pipe 6, which is arranged at a front end of a body frame 5 through a steering stem 4. A steering handlebar 4*a* is installed in an upper part of the steering stem 4, and is attached to the front fork 3 for controlling movement thereof.

A main frame 7 extends rearwardly from the head pipe 6, and is connected to a pivot frame 8. A front end portion of a swing arm 9 is vertically swingably, and pivotally supported on the pivot frame 8. A rear wheel 11 is supported on a rear end portion of the swing arm 9. A shock absorber 12 is inserted between the swing arm 9 and the body frame 5. An engine (internal combustion engine) 13 is mounted inside the body frame 5.

The left arm portion of the swing arm 9 is hollow, into which the drive shaft derived from the engine 13 is inserted. The power is transmitted from the engine 13 to the rear wheel 11 through the drive shaft.

A front portion of the body of the motorcycle 1 is covered with a front cowl 15. A rear portion of the body is covered with the rear cowl 16. Right and left pania cases 17 are built in both sides of the rear portion of the rear cowl 16. A fuel tank 18 is arranged at a predetermined position above the main frame 7. A seat 19 is arranged at a predetermined position behind the fuel tank 18.

Figure 2:
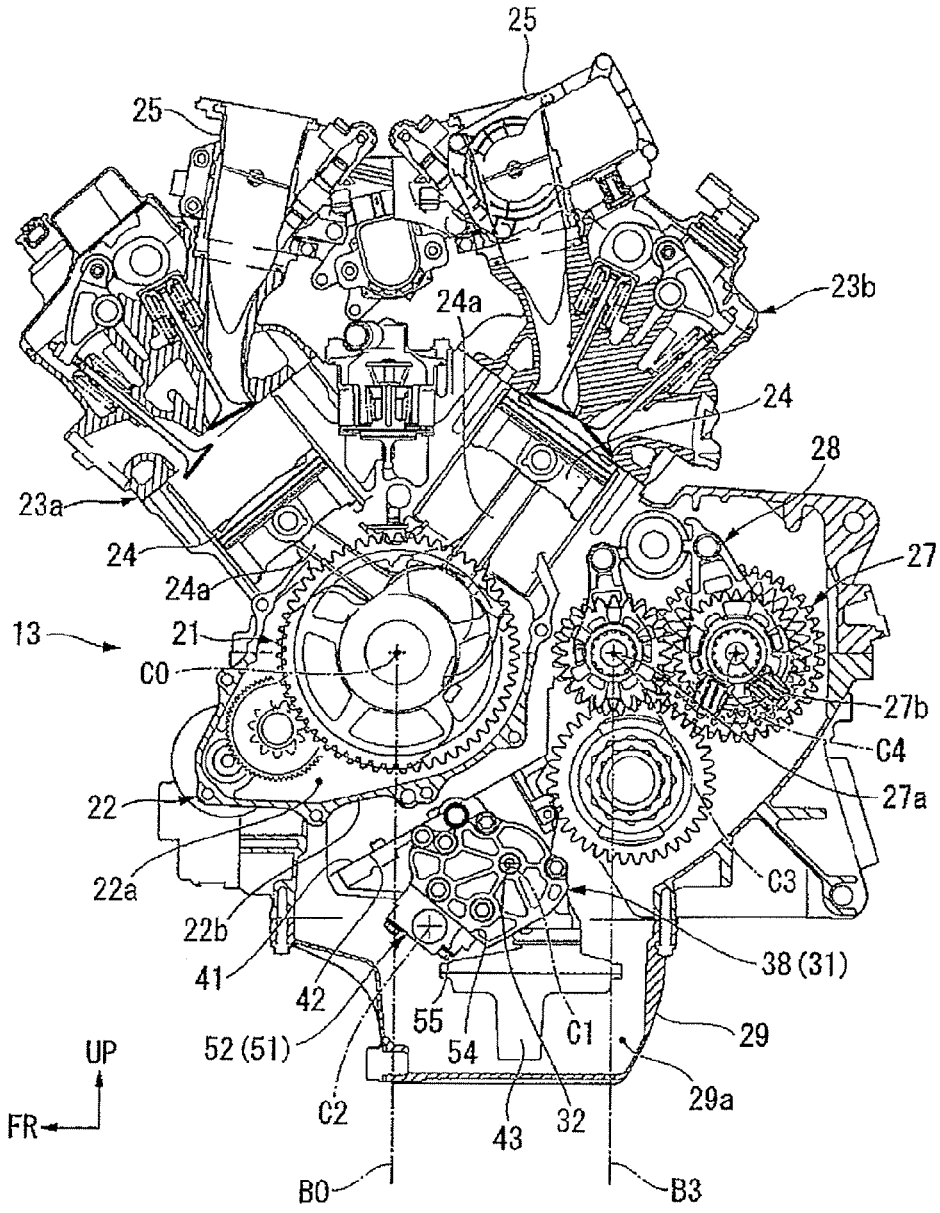
FIG. 2 is a left side view of an engine of the motorcycle.

As shown in FIG. 2, the engine 13 is a v-type engine wherein a rotation center axis C0 of the crankshaft 21 is along the width direction of the vehicle (right and left direction), a front cylinder 23*a* and a rear cylinder 23*b* are provided so as to stand on the crankcase 22. Pistons 24 are reciprocably fitted into the front cylinder 23*a* and the rear cylinder 23*b* respectively. The reciprocation by each piston 24 is transmitted into the rotation of the crankshaft 21 through a connecting rod 24*a*.

A throttle body 25 is disposed between the front cylinder 23*a* and the rear cylinder 23*b*, which is connected to each inlet port thereof. An exhaust pipe 26 is disposed in front of the front cylinder 23*a* and behind the rear cylinder 23*b*, which is extended from each exhaust ports thereof.

A transmission unit 27 is arranged in the rear portion of the crankcase 22. Various components included in the engine 13 are: a main shaft 27*a* as the input shaft of the transmission unit 27; a counter shaft 27*b* as the output shaft of the transmission unit 27; a change mechanism 28 which changes shift stage of the transmission unit 27; an oil pan 29 installed in the lower part of the crankcase 22; and an oil pump unit 31 compressing and feeding the engine oil inside the oil pan 29 (hereinafter, just refereed to as the oil) to each engine portion. The main shaft 27*a* and the counter shaft 27*b* have rotation center axes C3, C4 respectively which are parallel to the crank axis C0.

With the reference to FIG. 2, the oil pump unit 31 is installed inside the lower part of the crankcase 22. The oil pump unit 31 is operated in conjunction with the rotation of the rotation member (the crankshaft 21 or including the clutch outer of the multiple plate clutch to which the rotary power is continuously transmitted) which continuously rotate while the engine 13 is operated.

The oil pump unit 31 has a pump drive shaft (hereinafter, referred to as the drive shaft) 32 which is parallel to the crankshaft 21. A driven member (for example, driven sprocket) 32*a* for interlocking with the rotation member is integrally and rotatably installed in the right end portion of the drive shaft 32. The rotational center axis of the drive shaft 32 is indicated by a sign C1.

Figure 3:
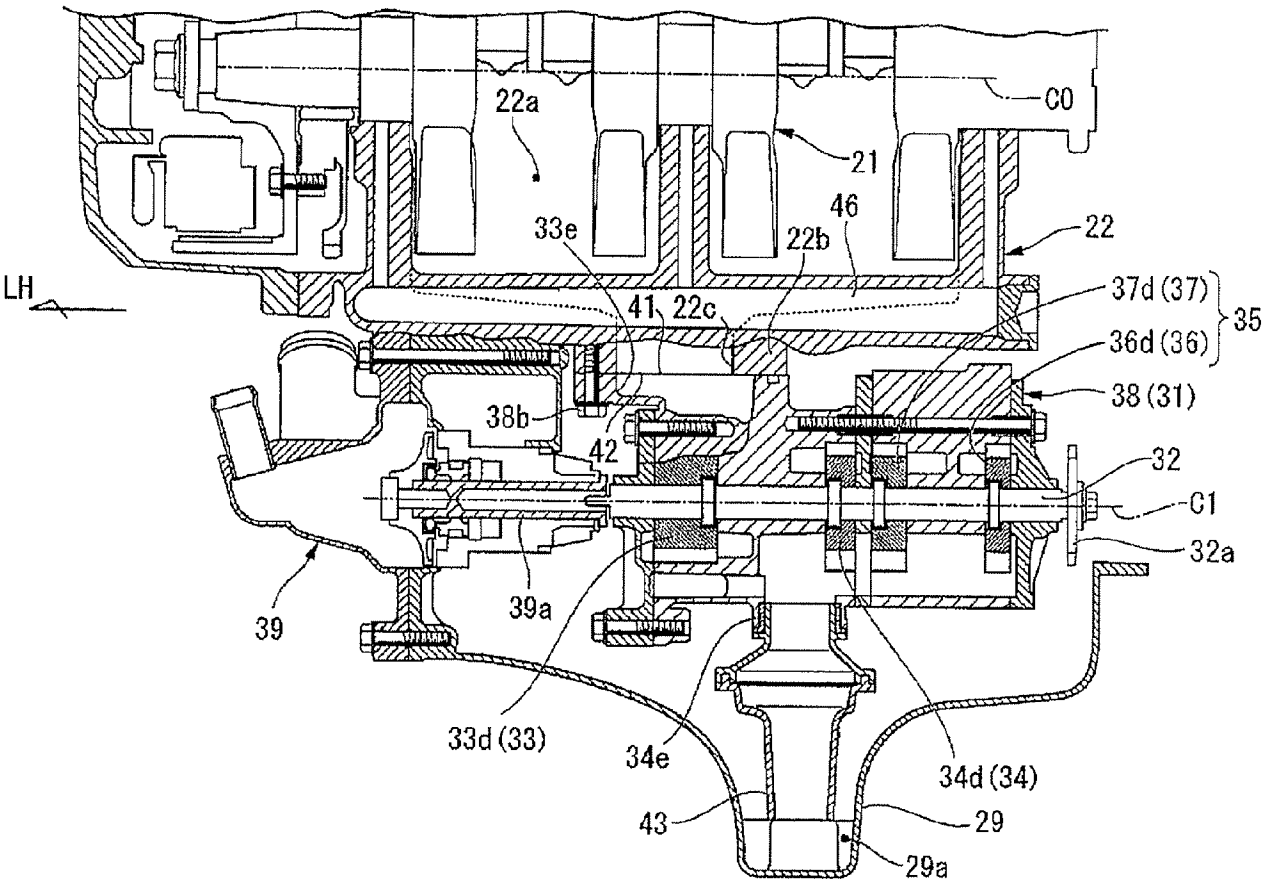
FIG. 3 is a cross-sectional view of the main part of the engine, which is cut off so as to be parallel to the crankshaft axis and seen from the rear side thereof.

As shown in FIG. 3, the oil pump unit 31 has a configuration in which a plurality of trochoid-type oil pumps are arranged along the right and left direction (parallel to the crankshaft axis C0).

Specifically, the oil pump unit 31 has a configuration in which a scavenging pump 33, a feed pump 34, and a control pump 35 generating hydraulic pressure for controlling apparatuses including a transmission and a valve system are coaxially and orderly arranged from the left side.

The feed pump 34 compresses and feeds the oil inside the oil pan 29 under the crankcase 22 to the oil feeding point of each part of the engine. The scavenging pump 33 returns the oil from the space in the crankcase 22 (hereinafter, also referred to as crank chamber 22*a*), which contains the crankshaft 21, to the space inside the oil pan 29 (hereinafter, also referred to as an oil pan chamber 29*a*). The control pump 35 supplies hydraulic pressure for actuation to the apparatuses. The crank chamber 22*a* has a bottom wall 22*b*.

Figure 5:
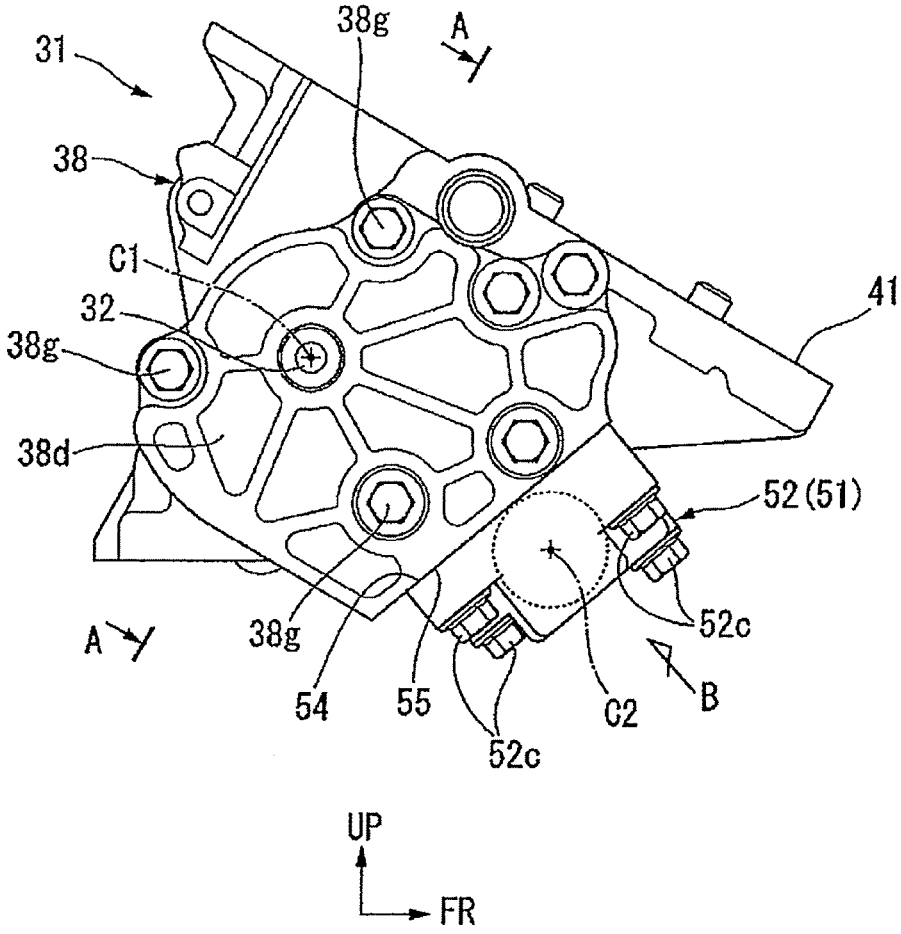
FIG. 5 is a right side view of the oil pump unit of the engine.
Figure 6:
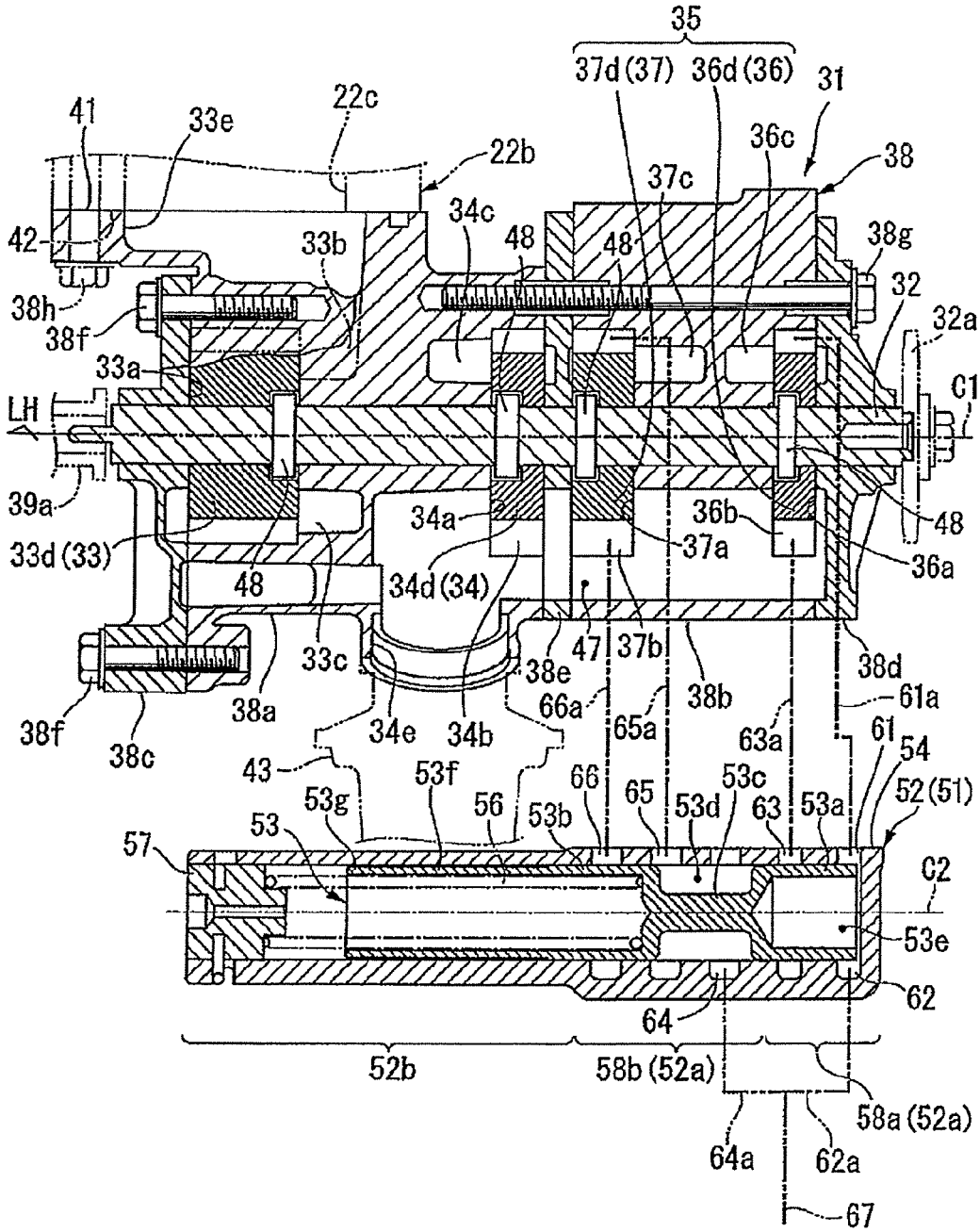
FIG. 6 is an explanatory drawing which adds the cross-sectional view of the oil passage switching valve to the cross-sectional view taken from the A-A line in FIG. 5.

With the reference to FIGS. 5 and 6, the oil pump unit 31 has a single pump body 38 and a single drive shaft 32 which are shared by each pump 33, 34, and 35. The right end portion of the drive shaft 32 is projected from the right end portion of the pump body 38. The driven member 32*a* is fixed on the right end portion of the drive shaft 32. The left end portion of the drive shaft 32 is projected from the left end of the pump body 38. The right end portion of a drive shaft 39*a* of a water pump 39 (see FIG. 3) is integrally and rotatably engaged with the left end portion of the drive shaft 32. In other words, the water pump 39 has a drive shaft 39*a* along the right and left direction, the drive shaft 39*a* is coaxially disposed with the drive shaft 32 of the oil pump unit 31.

The pump body 38 separately includes the feed pump 34 and rotor containing portions 33*a*, 34*a* for the scavenging pump 33, inlet ports 33*b*, 34*b* and a left split body 38*a* forming discharge ports 33*c*, 34*c*, rotor containing portions 36*a*, 37*a* for the first and second oil pumps 36, 37 in the control pump 35, a right split body 38*b* forming inlet ports 36*b*, 37*b* and discharge ports 36*c*, 37*c*, a left lid body 38*c* blocking up the left end of the left split body 38*a*, a right lid body 38*d* blocking up the right end portion of the right split body 38*b*, and a separating plate 38*e* sandwiched between the right and left split bodies 38*a*, 38*b*.

The left lid body 38*c* is fasten and fixed on the left end of the left split body 38*a* with a plurality of bolts 38*f*, a right lid body 38*d* is fasten and fixed on the right end of the left split body 38*a* with a plurality of long bolts 38*g* penetrating the right split body 38*b* and the separating plate 38*e*. Accordingly, each split body 38*a*, 38*b*, each lid body 38*c*, 38*d* and the separating plate 38*e* are integrally combined.

Each rotor containing portion 33*a*, 34*a* contains each pump rotor 33*d*, 34*d* of the scavenging pump 33 and the feed pump 34 respectively. Each pump rotor 33*d*, 34*d* has a well-known configuration which consists of an outer rotor and an inner rotor. Each pump rotor 33*d*, 34*d* (inner rotor) is integrally rotatable with the drive shaft 32 retained on the central part of the pump body 38.

In addition, with reference to FIG. 2, the engine mounting surface 41 inclined forwardly and downwardly in a state that the oil pump unit 31 is mounted in the engine 13 (motorcycle 1) is formed on the left upper portion of the pump body 38. The engine mounting surface 41 is flatly formed along the right and left direction. The engine mounting surface 41 is oil-tightly fit together from the lower part with a pump mounting surface 42 under the bottom wall 22*b* of the crank chamber 22*a*. In the state, the pump body 38 (oil pump unit 31) is fastened and fixed on the bottom wall 22*b* of the crank chamber 22*a* with a plurality of bolt 38*h*.

With the reference to FIG. 6, the inlet port 33*b* of the scavenging pump 33 is formed on the upper left side of the left split body 38*a*. The inlet port 33*b* extends to the engine mounting surface 41 side which is in the upper portion thereof and opens the inlet 33*e* on the engine mounting surface 41. The opening 22*c* is formed on the pump mounting surface 42 of the bottom wall 22*b* of the crank chamber 22*a* so as to be opposite to the inlet 33*e*. The inlet 33*e* and the opening 22*c* are communicated with each other in a state that the oil pump unit 31 is mounted on the crankcase 22.

The discharge port 33*c* opening to oil pan chamber 29*a* of the scavenging pump 33 is formed on the lower right side of the left split body 38*a*. Accordingly, when the oil pump unit 31 is driving, the scavenging pump 33 sucks the oil inside the crank chamber 22*a* from the inlet port 33*b*, simultaneously, and returns the oil by discharging from the discharge port 33*c* to the oil pan chamber 29.

Further, with reference to FIG. 2, the bottom wall 22*b* as a partition wall dividing the crank chamber 22*a* and the oil pan chamber 29*a* is formed in a circular shape when viewed from the side so as to be along the rotatable trajectory of the crank web. The opening 22*c* is formed on the lower end portion of the bottom wall 22*b*.

Figure 4:
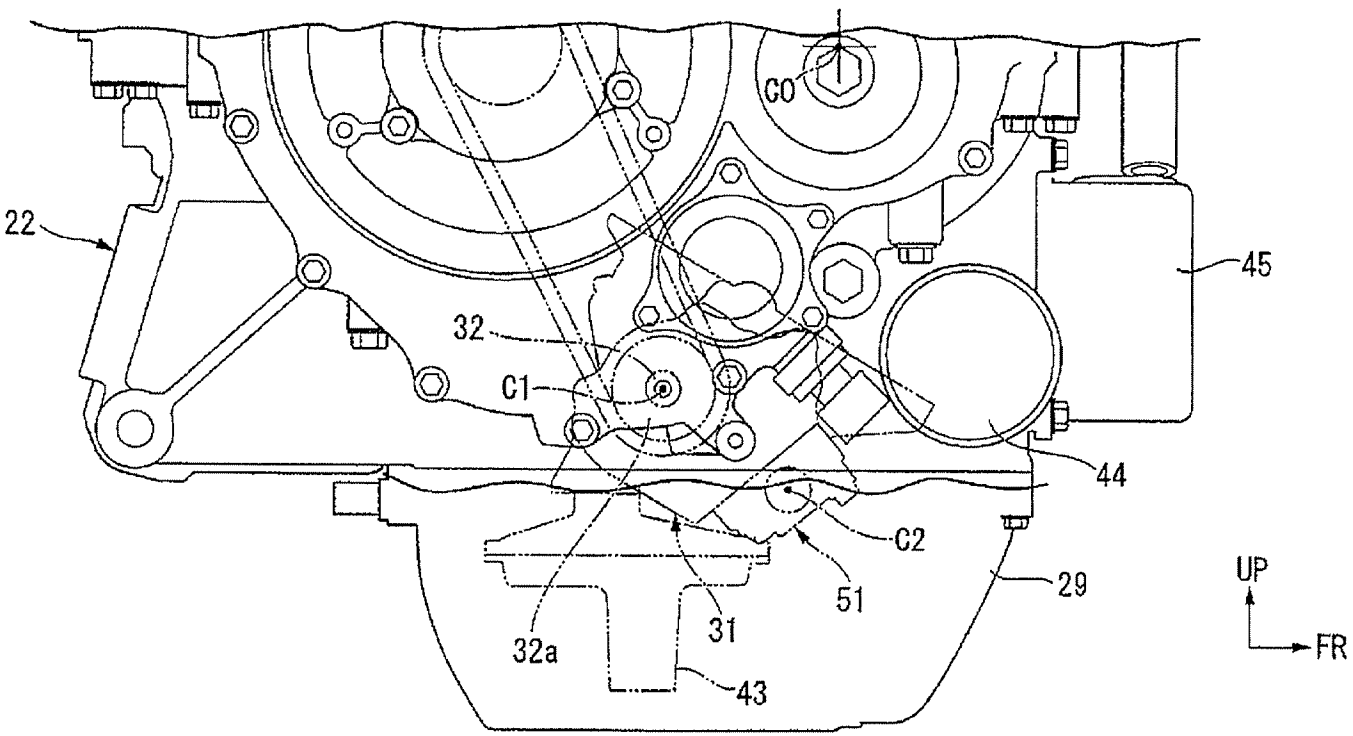
FIG. 4 is a right side view of the main part of the engine.

In addition, with reference to FIGS. 3 and 4, the inlet port 34*b* of the feed pump 34 is formed on the lower right side of the left split body 38*a*. The inlet port 34*b* extends downwardly in a nozzle shape, opens the inlet 34*e* to the oil pan chamber 29*a*. The upper end portion of a strainer 43 soaked in the oil inside the oil pan chamber 29*a* is connected into the inlet 34*e*.

The discharge ports 34*c* communicated with the oil feeding passage to each engine portion in the feed pump 34 is formed on the upper right side of the left split body 38*a*. Accordingly, when the oil pump unit 31 is driving, the feed pump 34 sucks oil inside the oil pan chamber 29*a* from the inlet port 34*b* through the strainer 43, simultaneously, the oil is discharged from the discharge port 34*c* and is compressed and fed to each engine portion. The oil discharged from the feed pump 34 is reached to a main oil gallery 46 through an oil filter 44 and the oil cooler 45 and so on, and then is appropriately supplied to the oil feeding point of each engine portion.

With the reference to FIG. 6, a communication space 47, which extends in the right and left direction containing the inlet port 34*b* of the feed pump 34 as well as each inlet port 36*b*, 37*b* of the first and the second oil pumps 36, 37 of the control pump 35, is formed inside the lower portion of the pump body 38. The feed pump 34 as well as the first and the second oil pumps 36, 37 suck the oil fed into the communication space 47 through the strainer 43 from each inlet port 34*b*, 36*b*, and 37*b*.

The control pump 35 has the first oil pump 36 and the second oil pump 37 arranged in the direction along the drive shaft 32 (the right and left direction, hereinafter, also referred to as the pump axial direction).

The first oil pump 36 is a main pump continuously communicated with an oil feeding passage 67 heading for each engine portion (the apparatuses); the second oil pump 37 is a sub-pump switching the state of the communication with the oil feeding passage 67 by the operation of the after-mentioned oil passage switching valve 51.

The first oil pump 36 contains the pump rotor 36*d* on the rotor containing portion 36*a* of the right side of the right split body 38*b*, the second oil pump 37 containing the pump rotor 37*d* on the rotor containing portion 37*a* of the left side of the right split body 38*b*. Namely, the first oil pump 36 is disposed further outside of the pump body 38 than the second oil pump 37 in the pump axial direction. The driven member 32*a* is disposed further outside in the pump axial direction than the first oil pump 36.

Each inlet port 36*b*, 37*b* of the first and second oil pumps 36, 37 opens into the communication space 47, each discharge ports 36*c*, 37*c* of the first and second oil pumps 36, 37 separately open into the upper portion of the pump body 38.

The first and second oil pumps 36, 37, the feed pump 34, as well as, each inlet port 33*b*, 34*b*, 36*b*, 37*b* of the scavenging pump 33 are provided so to be arranged in a line in the pump axial direction. Similarly, the first and second oil pumps 36, 37, the feed pump 34 as well as, each discharge port 33*c*, 34*c*, 36*c*, 37*c* of the scavenging pump 33 are provided so to be arranged in a line in the pump axial direction.

Each pump rotor 36*d*, 37*d* has a well-known configuration consisting of the outer rotor and the inner rotor. Each pump rotor 36*d*, 37*d* (the inner rotor) is integrally rotatable with the drive shaft 32. The width (thickness) of the pump rotor 37*d* in the pump axial direction is about twice as the one of the pump rotor 36*d*. Namely, the basic flow amount (pump capacity) per a rotation of the second oil pump 37 is about twice as the one of the first oil pump 36.

Here, the first and second oil pumps 36, 37 have the same discharge pitch each other and have the phase difference about half pitch each other, reduces the generation of the pulsation of the lubrication system.

Figure 7:
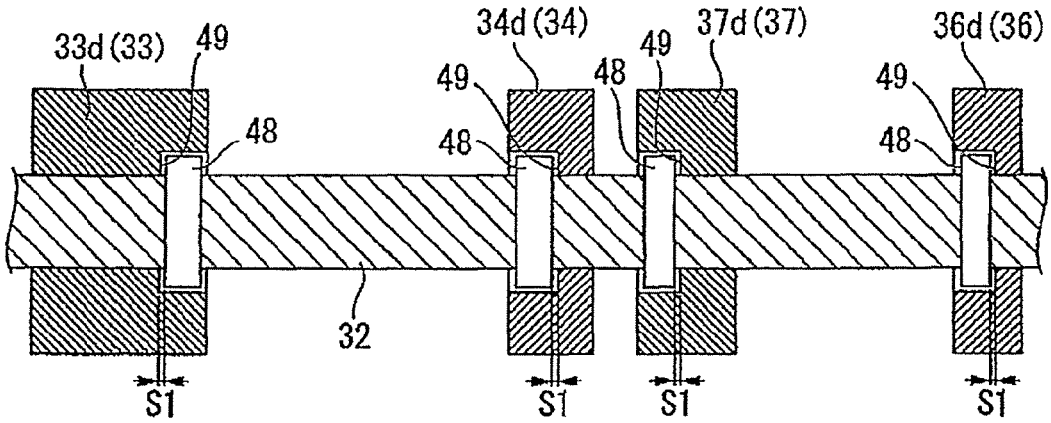
FIG. 7 is an enlarged view of the main part in FIG. 6.

In addition, with reference to FIG. 7, a plurality of engaging pin 48 which are integrally and rotatably engaged with the first and second oil pumps 36, 37, the feed pump 34 as well as the pump rotor 33*d*, 34*d*, 36*d*, 37*d* of the scavenging pump 33 is fixedly installed on the drive shaft 32 respectively. Engaging grooves 49 engaging the corresponding engaging pins 48 are formed on the left side surfaces of the pump rotor 36*d* of the first oil pump 36, the pump rotor 37*d* of the second oil pump 37, and the pump rotor 34*d* of the feed pump 34 respectively. The engaging grooves 49 engaging the corresponding engaging pins 48 are formed on the right side surface of the pump rotor 33*d* of the scavenging pump 33.

Therefore, clearance S1 relating to the axial direction (pump axial direction) of the drive shaft 32 are formed between each engaging pin 48 and each bottom surface of the corresponding engaging groove 49.

The oil sucked into the first and second oil pumps 36, 37 is discharged from each discharge port 36*c*, 37*c*, and then by passing through the oil passage switching valve 51 is properly supplied to at least one of the first and second oil passages 62*a*, 64*a* joining in the oil feeding passage 67 and the first and second return passages 63*a*, 66*a* reaching to each inlet port 36*b*, 37*b*.

With the reference to FIG. 6, the oil passage switching valve 51 consists of a so-called spool valve selectively switching the communication state between the discharge ports 36*c*, 37*c* of the first and second oil pumps 36, 37, and between the first and second oil passages 62*a*, 64*a* and the first and second return passages 63*a*, 66*a*. The oil passage switching valve 51 has a cylindrical valve body 52 along the longitudinal direction (right and left direction). A valve main body 53 reciprocably inserted into the valve body 52 in the right and left direction.

The oil passage switching valve 51 is formed in a rod-shaped parallel to the crankshaft axis C0 (parallel to the right and left direction), and is disposed further downward than the drive shaft 32 as well as obliquely forward and downward of the pump body 38 (see FIGS. 2 and 5) in a state wherein the engine 13 (motorcycle 1) is mounted. In addition, the sign C2 shows the central axis of the oil passage switching valve 51.

The oil passage switching valve 51 is located obliquely rearward and downward of the oil filter 44 when viewed from the side. The oil passage switching valve 51 (the valve body 52) and each pump 33, 34, 35 (the pump body 38) are disposed between the vertical line B0 passing through the shaft center (axis C0) of the crankshaft 21 when viewed from the side and the vertical line B3 passing through the shaft center (axis C3) of the main shaft 27*a*.

The pump body 38 and the oil passage switching valve 51 are disposed so as to overlap each other in the right and left direction. The strainer 43 is disposed within the right and left width of at least one of the pump body 38 and the oil passage switching valve 51 (the both thereof in the present embodiment).

With the reference to FIGS. 5 and 6, the valve body 52 is provided as a separate body with the pump body 38. The upper rear side of the right side portion (the oil passage forming portion 52*a*) of the valve body 52, the body mounting surface 54 inclined backwardly and downwardly is formed in a mounting state to the engine 13. The body mounting surface 54 is flatly formed along the right and left direction, the body mounting surface 54 is oil-tightly fit together from the downward to the valve mounting surface 55 formed on the lower front side of the valve body 52. In the state, the valve body 52 is fasten and fixed on the pump body 38 with a plurality of bolt 52*c*.

The left end of the valve body 52 opens to the left side, the valve main body 53 and a compression coil spring (hereinafter, also referred to as a spring) 56 biasing the valve main body 53 to the right side are inserted into the valve body 52 from the left end. The left end of the valve body 52 is blocked with the end cap 57; the spring 56 is compressed into a predetermined amount between the end cap 57 and the valve main body 53.

Orderly from the right end portion side, the right side portion of the valve body 52 has a first feed opening 61 communicating with a discharge ports 36*c* of a first oil pump 36 through a first feed passage 61*a*, a first return opening 63 communicating with an inlet port 36*b* of the first oil pump 36 through a first return passage 63*a*, a second deriving opening 64 communicating with a second oil passage 64*a*, a second feed opening 65 communicating with a discharge port 37*c* of a second oil pump 37 through a second feed passage 65*a*, and a second return opening 66 communicating with an inlet port 37*b* of the second oil pump 37 through a second return passage 66*a*. The first feed opening 61 is formed including a first deriving opening 62 communicated with a first oil passage 62*a*.

Hereinafter, in the oil passage switching valve 51, the region (right side portion) forming each feed opening 61, 65, each deriving opening 62, 64, and each return opening 63, 66 is called as an oil passage forming portion 52*a*, the region (left side portion) extended to the left side and mainly containing the spring 56 is called as a drive portion 52*b*. The drive portion 52*b* is formed thinner than the oil passage forming portion 52*a*.

Figure 10:
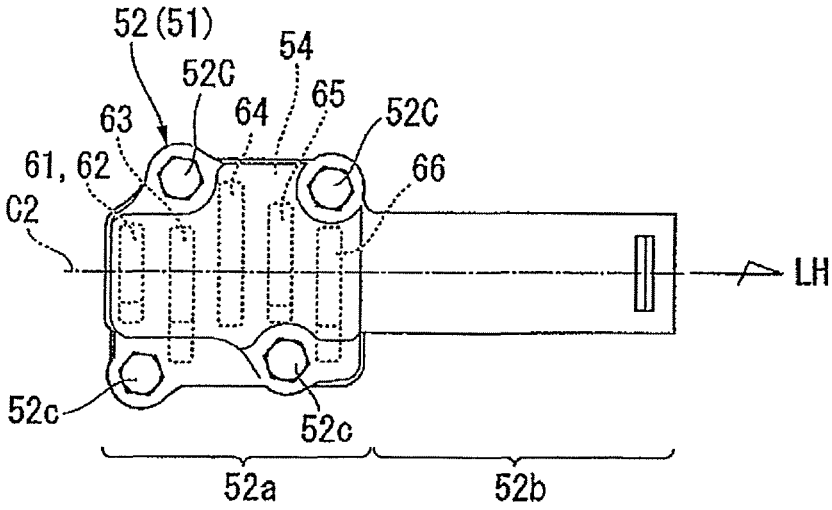
FIG. 10 is an arrow view of the oil passage switching valve seen from the B direction in FIG. 5.
Figure 11:
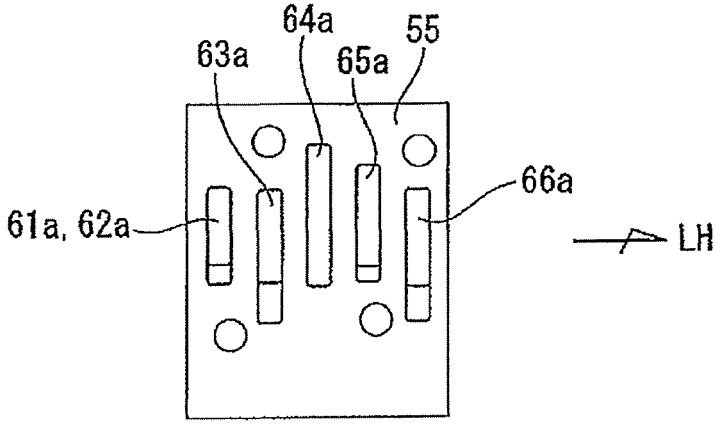
FIG. 11 is an arrow view of the valve mounting surface of the oil pump unit seen from the B direction in FIG. 5.

In addition, with reference to FIGS. 10 and 11, the first feed opening 61 (a first deriving opening 62), the first return opening 63, the second deriving opening 64, the second feed opening 65, and the second return opening 66 are orderly formed from the left side so as to be perpendicular to the pump axial direction and opened in a slit-like shape on the body mounting surface 54 formed on the upper rear side of the oil passage forming portion 52*a*.

On the other hand, the first feed passage 61*a* (a first oil passage 62*a*), the first return passage 63*a*, the second oil passage 64*a*, the second feed passage 65*a*, the second return passage 66*a* are orderly formed from the left side so as to be perpendicular to the pump axial direction and opened in a slit-like shape on the valve mounting surface 55 formed on the lower front side of the pump body 38.

In other words, on the valve mounting surface 55, the discharge ports 36*c* of the first oil pump 36 is opened through the first feed passage 61*a*, the inlet port 36*b* of the first oil pump 36 is opened through the first return passage 63*a*, the discharge ports 37*c* of the second oil pump 37 is opened through the second feed passage 65*a*, the inlet port 37*b* of the second oil pump 37 is opened through the second return passage 66*a*.

With the reference to FIG. 6, the right side portion of the valve main body 53 is a first valve portion 53*a* forming a cylindrical shape with a bottom, which opens to the right side, the left side portion of the valve main body 53 is a second valve portion 53*b* forming a cylindrical shape with a bottom, which opens to the left side. The first valve portion 53*a* is inserted into the right side of the oil passage forming portion 52*a*, the second valve portion 53*b* is inserted into the left side portion of the oil passage forming portion 52*a*.

Each valve portion 53*a*, 53*b* appropriately opens and closes each feed opening 61, 65, each deriving opening 62, 64, and each return opening 63, 66 by slidably contacting the outer periphery surface with the inner periphery surface of the oil passage forming portion 52*a*.

Each valve portion 53*a*, 53*b* is spaced apart into the right and left direction from each other, each valve portion 53*a*, 53*b* is integrally connected through a connecting portion 53*c*. The connecting portion 53*c* is formed in a further narrow rod-shape than each valve portion 53*a*, 53*b*, the connecting portion 53*c* is inserted with the second valve portion 53*b* into the left side portion of the oil passage forming portion 52*a* (into a second oil passage switching portion 58*b*). An annular space 53*d* is formed between the outer periphery surface of the connecting portion 53*c* and the inner periphery surface of the oil passage forming portion 52*a*.

Hereinafter, a first oil passage switching portion 58*a* is the right side region of the oil passage forming portion 52*a* containing the first valve portion 53*a* when the valve main body 53 is completely moved to the right side, a second oil passage switching portion 58*b* is the left side of the region of the oil passage forming portion 52*a* containing the second valve portion 53*b* and the connecting portion 53*c* when the valve main body 53 is completely moved to the right side.

The first feed opening 61, the first deriving opening 62 and the first return opening 63 are opened inside the first oil passage switching portion 58*a*, the second feed opening 65, the second deriving opening 64 and the second return opening 66 are opened inside the second oil passage switching portion 58*b*.

In the oil passage forming portion 52*a*, the second oil passage switching portion 58*b* corresponding to the second oil pump 37 which discharges comparatively larger amount becomes wider than the first oil passage switching portion 58*a* corresponding to the first oil pump 36 which discharges comparatively smaller amount in the longitudinal direction of the valve.

In the state wherein the valve main body 53 is completely moved to the right side, the oil can be distributed between the right end portion of the first valve portion 53*a* and the right bottom portion of the valve body 52, the first feed opening 61 and the first deriving opening 62 which are provided on the right end side of the valve body 52 in the longitudinal direction (right and left direction) of the valve are communicated with the distribution portion.

Accordingly, the inner space of the first valve portion 53*a* is constantly subjected to the hydraulic pressure from the discharge port 36*c*. Namely, the inner space of the first valve portion 53*a* is a hydraulic pressure receiving portion 53*e* constantly subjected to the hydraulic pressure from the first oil pump 36. The valve main body 53 is moved to the left side against the bias force of the spring 56 by the hydraulic pressure from the first oil pump 36, to which the hydraulic pressure receiving portion 53*e* is subjected.

An extension portion 53*f* formed in a slightly thin-walled and cylindrical shape is integrally and consecutively installed in the left side of the second valve portion 53*b*. The extension portion 53*f* is inserted into the drive portion 52*b* in a state wherein the spring 56 is contained inside thereof. The extension portion 53*f* is a guide for expansion and contraction of the spring 56 when the valve main body 53 is moved. The left end portion of the extension portion 53*f* is a stopper portion 53*g* which abuts on an end cap 57 when the valve main body 53 moves to the further left side than a predetermined amount and restricts the movement of the valve main body 53 to the further left side than a predetermined amount.

With the reference to FIG. 6, when the valve main body 53 is completely moved to the right side, the first feed opening 61 and the first deriving opening 62 are communicated with each other, simultaneously, the second feed opening 65 and the second deriving opening 64 are communicated with each other through the space 53*d*. At this time, the first return opening 63 is closed by the first valve portion 53*a*; the second return opening 66 is closed by the second valve portion 53*b*.

Figure 8:
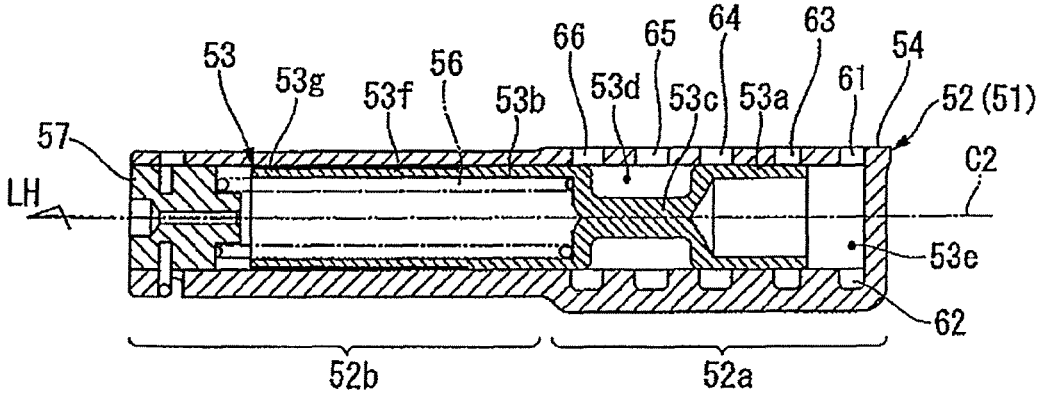
FIG. 8 is a first actuation explanation drawing of the oil passage switching valve.

On the other hand, with the reference to FIG. 8, when the valve main body 53 moves to the left side at a predetermined amount, while the first feed opening 61 and the first deriving opening 62 are communicated with each other, the second deriving opening 64 is closed by the first valve portion 53*a*, simultaneously, the second feed opening 65 and the second return opening 66 are communicated with each other through the space 53*d*. At this time, the second deriving opening 64 is closed by the first valve portion 53*a*.

Figure 9:
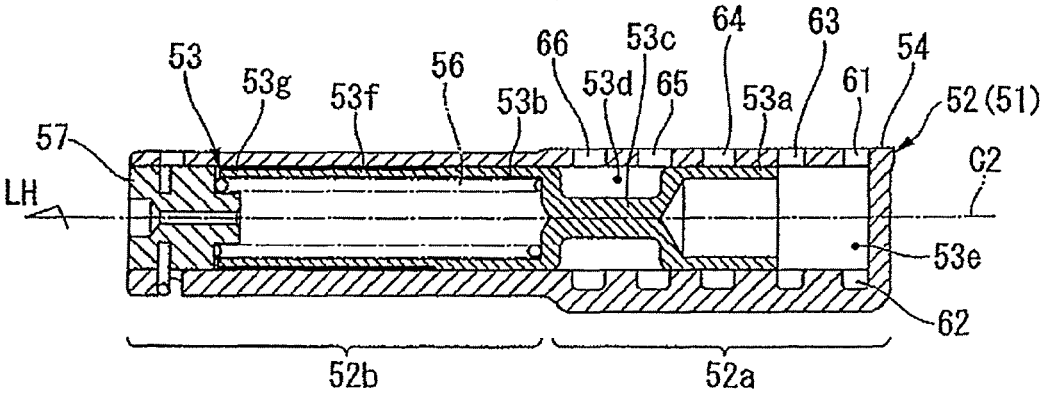
FIG. 9 is a second actuation explanation drawing of the oil passage switching valve.

With the reference to FIG. 9, when the valve main body 53 moves to the further left side, the first feed opening 61 and the first deriving opening 62 are additionally communicated with the first return opening 63.

Here, in the state wherein the engine 13 and the oil pump unit 31 are in low rotation and the discharging pressure of the first oil pump 36 is low, the valve main body 53 is not moved to the left side and is completely moved to the right side (see FIG. 6). At the time, as mentioned above, the first feed opening 61 and the first deriving opening 62 are communicated with each other. Simultaneously, the second feed opening 65 and the second deriving opening 64 are communicated with each other through the space 53*d*. Accordingly, whole of the hydraulic pressure from the first and second oil pumps 36, 37 is fed to the apparatuses through the oil feeding passage 67.

Due to such configuration, if the rotations of the engine 13 and the oil pump unit 31 are increased and then the discharging pressure of the first oil pump 36 is increased, the valve main body 53 is moved to the left side at a predetermined amount (see FIG. 8) subjected to the hydraulic pressure. At this time, as mentioned above, while the first feed opening 61 and the first deriving opening 62 are communicated with each other, the second deriving opening 64 is closed by the first valve portion 53*a*. Simultaneously, the second feed opening 65 and the second return opening 66 are communicated with each other through the space 53*d*. Accordingly, whole of the hydraulic pressure from the first oil pump 36 is fed to the apparatuses through the oil feeding passage 67; the hydraulic pressure from the second oil pump 37 is recirculated to the inlet port 37*b* of the second oil pump 37 through the second return passage 66*a*.

Then, moreover, if the rotations of the engine 13 and the oil pump unit 31 are increased and the valve main body 53 is moved to the further left side, as mentioned above, the first feed opening 61, the first deriving opening 62 and the first return opening 63 are communicated with each other (see FIG. 9). Accordingly, a part of hydraulic pressure from the first oil pump 36 is recirculated to the inlet port 36*b* of the first oil pump 36 as a surplus hydraulic pressure through the first return passage 63*a*. In the state, the movement of the valve main body 53 to the further left side is reduced (in a state wherein the valve main body 53 is completely moved to the left side.

As the above-mentioned embodiment, the engine 13 having the variable flow rate oil pump apparatus (oil pump unit 31), wherein the oil pumps 36, 37 are formed containing the pump rotors 36*d*, 37*d* which drive interlocking for rotation with the crankshaft 21 inside the pump body 38, the rod-shaped oil passage switching valve 51 is equipped in the discharge ports 36*c*, 37*c* of the oil pumps 36, 37 in the pump body 38, the oil pump unit 31 is equipped, which can control the discharge amount of the whole pump due to the fact that oil return openings 63, 66 facing to the discharge ports 36*c*, 37*c* are opened and closed by the operation of the oil passage switching valve 51, The axial direction of the oil passage switching valve 51 and the axial direction of the drive shaft 32 of the pump rotors 36*d*, 37*d* are disposed so as to be parallel to the axial direction of the crankshaft 21, simultaneously, the pump body 38 and the oil passage switching valve 51 are disposed so as to overlap each other in the axial direction of the crankshaft 21.

With such configuration, the layout space of the oil pump including the oil passage switching valve 51 can be reduced, the effect on parts around the pump is restricted, simultaneously, and the oil pump and thus the engine 13 can be downsized.

In addition, in the above-mentioned engine 13, the oil pan 29 is equipped under the crankcase 22 containing the crankshaft 21, the strainer 43 extending in the vertical direction is provided inside the oil pan 29, the strainer 43, the pump body 38, and the oil passage switching valve 51 are disposed so as to overlap each other in the axial direction of the crankshaft 21.

With this configuration, due to the fact that the strainer 43, the pump body 38, and the oil passage switching valve 51 are adjacently disposed in the axial direction of the crankshaft 21, the oil pump can be downsized furthermore.

In addition, in the engine 13 of the present invention, the oil pumps 36, 37 are a plurality of oil pumps which are coaxially arranged.

With this configuration, a plurality of oil pumps 36, 37 can be arranged at a predetermined position without increasing the pump drive shaft.

In addition, in the above-mentioned engine 13, each oil pump 36, 37 shares the strainer 43.

With this configuration, the structure around the oil pump can be simplified without providing the strainer and the inlet on each oil pump 36, 37.

In addition, in the above-mentioned engine 13, the scavenging pump 33 is coaxially equipped with each oil pump 36, 37, the opening 22*c* connecting an inlet 33*e* of the scavenging pump 33 is formed on the bottom wall 22*b* of the crank chamber 22*a* of the crankcase 22.

With this configuration, the scavenging pump 33 can be compactified by integrally provided with each oil pump 36, 37, simultaneously, the oil inside of the crank chamber 22*a* can be efficiently discharged into the oil pan 29.

In addition, in the above-mentioned engine 13, the transmission unit 27 which shifts the rotary power of the crankshaft 21 is equipped, the transmission unit 27 has the main shaft 27*a* which is parallel to the axial direction of the crankshaft 21, when viewed from the axis direction of the crankshaft 21 and the main shaft 27*a*, the pump body 38 is disposed between the vertical line B0 passing through the shaft center (axis C0) of the crankshaft 21 and the vertical line B3 passing through the shaft center (axis C3) of the main shaft 27*a*.

With this configuration, the oil pumps 36, 37 can be efficiently disposed in the downward space between the crankshaft 21 and the main shaft 27*a*.

In addition, in the above-mentioned engine 13, the oil passage switching valve 51 is disposed in the obliquely lower part of the pump body 38.

With this configuration, the oil pump 36, 37 can be downsized by reducing the width in the front and rear direction and the width in the upper and lower direction.

In addition, in the above-mentioned engine 13, the oil filter 44 is disposed in the obliquely upper part of the oil passage switching valve 51 when viewed from the axis direction of the crankshaft 21.

With this configuration, the space formed by the obliquely downward offset of the oil passage switching valve 51 can be effectively used as the layout space of the oil filter 44.

In addition, in the above-mentioned engine 13, one side in the longitudinal direction of the oil passage switching valve 51 is formed as the oil passage forming portion 52*a*, the other side thereof is formed as the drive portion 52*b*, and the oil passage forming portion 52*a* is installed in the pump body 38.

With this configuration, the valve installing structure can be simplified by installing only the oil passage forming portion 52*a* of the oil passage switching valve 51 on the pump body 38.

Moreover, the present invention is not limited within the above-mentioned embodiment, and may be applied, to a structure without scavenging pump, and to a variable flow rate oil pump apparatus wherein a control pump has more than three oil pumps and the like. In addition, the present invention can be applied not only to v-type engine but also to various kinds of engines including parallel engine or single cylinder engine and the like.

Therefore, the above-mentioned embodiment is an example of the present invention. Needless to say that various changes including the applications not only to a motorcycle (a motorized bicycle and a scooter-type vehicle) but also to a three-wheeled vehicle (including a vehicle with one front wheel and two rear wheel and a vehicle with two front wheel and one rear wheel type) or a four-wheeled vehicle can be made without departing from the scope of the present invention.

In other words, although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. An internal combustion engine comprising:

a crankcase;

a crankshaft disposed in said crankcase;

a variable flow rate oil pump apparatus having a pump body comprising a plurality of oil pumps arranged inside the pump body, each of said oil pumps having a pump rotor which is interlockingly arranged with said crankshaft for rotation thereof; said pump body comprising discharge ports having a rod-shaped oil passage switching valve disposed therein;

wherein said variable flow rate oil pump apparatus is operable to control discharge amount thereof by operating said oil passage switching valve to open and close oil return openings which communicate with respective said discharge ports of said oil pumps; and wherein an axial direction of said oil passage switching valve, and an axial direction of a drive shaft of said oil pumps are arranged parallel to an axial direction of said crankshaft.

2. An engine with a variable flow rate oil pump apparatus according to claim 1, characterized in that said oil pumps and said oil passage switching valve are arranged so as to overlap each other in the axial direction of said crankshaft.

3. An engine with a variable flow rate oil pump apparatus according to claim 2, further comprising:

an oil pan which is disposed under said crankcase; and a strainer extending in a vertical direction arranged inside said oil pan;

wherein said strainer, at least one of said oil pumps and said oil passage switching valve are arranged so as to overlap each other in the axial direction of said crankshaft.

4. An engine with a variable flow rate oil pump apparatus according to claim 1, wherein said oil pumps are coaxially arranged.

5. An engine with a variable flow rate oil pump apparatus according to claim 4, further comprising an oil pan which is disposed under said crankcase; and a strainer arranged inside said oil pan and extending in a vertical direction, wherein each of said oil pumps shares said strainer.

6. An engine with a variable flow rate oil pump apparatus according to claim 4, further comprising a scavenging pump arranged coaxially with said oil pumps; and wherein an opening is formed on a bottom wall of a crank chamber of said crankcase, said opening in fluid communication with an inlet of said scavenging pump.

7. An engine with a variable flow rate oil pump apparatus according to claim 1, further comprising a transmission unit operatively connected with said crankshaft for shifting rotary power thereof; wherein said transmission unit has an input shaft arranged parallel to the axial direction of said crankshaft, when viewed from the axial direction of said crankshaft; and wherein said input shaft of the transmission unit and said oil pumps are arranged between a vertical line passing through a shaft center of said crankshaft and a vertical line passing through a shaft center of said input shaft of the transmission unit.

8. An engine with a variable flow rate oil pump apparatus according to claim 7, characterized in that the oil passage switching valve is disposed obliquely in a lower part of said oil pumps.

9. An engine with a variable flow rate oil pump apparatus according to claim 8, further comprising an oil filter arranged obliquely in an upper part of said oil passage switching valve when viewed from the axial direction of said crankshaft.

10. An engine with a variable flow rate oil pump apparatus according to claim 1, characterized in that, in a longitudinal direction of the oil passage switching valve, one side in of said oil passage switching valve is formed as an oil passage forming portion, and another side thereof is formed as a drive portion, and wherein said oil passage forming portion is installed in said oil pumps.

11. An internal combustion engine comprising:

a crankcase;

a crankshaft disposed in said crankcase;

a variable flow rate oil pump apparatus including a pump body having a plurality of oil pumps arranged on a shared drive shaft, said plurality of pumps comprising coaxially arranged first and second oil pumps; said first and second oil pumps having pump rotors interlockingly arranged with said crankshaft for rotation thereof; and a rod-shaped oil passage switching valve arranged in discharge ports of said first and second oil pumps in said pump body;

wherein said oil passage switching valve and said shared drive shaft of said first and second oil pumps are arranged such that an axial direction of said oil passage switching valve and an axial direction of the drive shaft of said first and second oil pumps are arranged parallel to an axial direction of said crankshaft; and wherein said first and second oil pumps and said oil passage switching valve are arranged so as to overlap each other in the axial direction of said crankshaft.

12. An internal combustion engine according to claim 11, further comprising a scavenging pump arranged coaxially with said first and second oil pumps.

13. An internal combustion engine according to claim 11, further comprising a transmission unit operatively connected with said crankshaft; said transmission unit having an input shaft arranged parallel to an axial direction of said crankshaft, when viewed from the axial direction of said crankshaft;

wherein said input shaft of the transmission unit and said first and second oil pumps are arranged between a vertical line passing through a shaft center of said crankshaft and a vertical line passing through a shaft center of said input shaft of the transmission unit.

14. An internal combustion engine according to claim 11, wherein said oil passage switching valve is disposed obliquely of said first and second oil pumps; and wherein said oil passage switching valve includes a drive portion formed on one side thereof, and an oil passage forming portion formed on another side thereof, said oil passage forming portion being operatively communicating with said first and second oil pumps.

15. An internal combustion engine according to claim 11, further comprising an oil filter arranged obliquely of said oil passage switching valve when viewed from the axial direction of said crankshaft.

16. A motorcycle comprising an internal combustion engine, said internal combustion engine comprising:

a crankcase;

a crankshaft disposed in said crankcase;

a variable flow rate oil pump apparatus comprising first and second oil pumps having pump rotors interlockingly arranged with said crankshaft for rotation thereof;

a rod-shaped oil passage switching valve arranged in discharge ports of said first and second oil pumps;

wherein said oil passage switching valve and said drive shaft of said first and second oil pumps are arranged such that an axial direction of said oil passage switching valve and an axial direction of the drive shaft of said first and second oil pumps are arranged parallel to an axial direction of said crankshaft; and wherein said first and second oil pumps and said oil passage switching valve are arranged so as to overlap each other in the axial direction of said crankshaft.

17. A motorcycle according to claim 16, further comprising a scavenging pump and a feed pump, each arranged coaxially with said first and second oil pumps.

18. A motorcycle according to claim 16, further comprising a transmission unit operatively connected with said crankshaft; said transmission unit having an input shaft arranged parallel to an axial direction of said crankshaft, when viewed from the axial direction of said crankshaft;

wherein said input shaft of the transmission unit and said first and second oil pumps are arranged between a vertical line passing through a shaft center of said crankshaft and a vertical line passing through a shaft center of said input shaft of the transmission unit.

19. A motorcycle according to claim 16, wherein said oil passage switching valve is disposed obliquely of said first and second oil pumps; and wherein said oil passage switching valve includes a drive portion formed on one side thereof, and an oil passage forming portion formed on another side thereof, said oil passage forming portion operatively communicating with said first and second oil pumps.

20. A motorcycle according to claim 16, further comprising an oil filter arranged obliquely of said oil passage switching valve when viewed from the axial direction of said crankshaft.

* * * * *